US005843296A

United States Patent [19]

Greenspan

[11] Patent Number: 5,843,296

[45] Date of Patent: Dec. 1, 1998

[54] METHOD FOR ELECTROFORMING AN OPTICAL DISK STAMPER

[75] Inventor: Alex Greenspan, Rockville Centre, N.Y.

[73] Assignee: Digital Matrix, Hempstead, N.Y.

[21] Appl. No.: 974,849

[22] Filed: Nov. 20, 1997

Related U.S. Application Data

[62] Division of Ser. No. 778,044, Dec. 26, 1996, Pat. No. 5,785,826.

[51] Int. Cl.[6] ..... C25D 1/10

[52] U.S. Cl. ..... 205/68; 205/70; 205/79

[58] Field of Search ..... 205/67, 68, 70, 205/79; 204/198, 212, 218, 297 R, 297 W

[56] References Cited

U.S. PATENT DOCUMENTS

| | | | |
|---|---|---|---|
| 3,627,666 | 12/1971 | Bonfils | 204/225 |
| 3,639,225 | 2/1972 | Malkowski et al. | 204/212 |
| 3,720,435 | 3/1973 | Leyn | 294/88 |
| 3,960,694 | 6/1976 | Champion et al. | 204/219 |
| 4,039,419 | 8/1977 | Buse | 204/225 |
| 4,052,062 | 10/1977 | Casavant | 473/74 |
| 4,072,595 | 2/1978 | Chambers et al. | 204/219 |
| 4,098,666 | 7/1978 | Ralston | 204/228 |
| 4,187,154 | 2/1980 | Dewallens | 204/5 |
| 4,210,513 | 7/1980 | Mutschler et al. | 204/225 |
| 4,297,197 | 10/1981 | Salman | 204/297 W |
| 4,309,265 | 1/1982 | Prusak | 204/279 |
| 4,385,978 | 5/1983 | Prusak | 204/281 |
| 4,414,070 | 11/1983 | Spence | 204/225 |
| 4,448,660 | 5/1984 | Fabian et al. | 204/225 |
| 4,500,394 | 2/1985 | Rizzo | 204/15 |
| 4,534,844 | 8/1985 | Prusak | 204/281 |
| 4,688,437 | 8/1987 | Becker et al. | 73/866.5 |
| 5,076,903 | 12/1991 | Westin | 204/279 |
| 5,124,016 | 6/1992 | Barbier | 204/222 |
| 5,135,636 | 8/1992 | Yee et al. | 205/96 |
| 5,167,792 | 12/1992 | Kamitakahara et al. | 205/68 |
| 5,227,041 | 7/1993 | Brogden et al. | 204/297 R |
| 5,242,563 | 9/1993 | Stern et al. | 204/241 |
| 5,254,239 | 10/1993 | Matyi et al. | 205/67 |
| 5,288,383 | 2/1994 | Sparwald et al. | 204/225 |

*Primary Examiner*—Kathryn Gorgos
*Assistant Examiner*—William T. Leader
*Attorney, Agent, or Firm*—Snell & Wilmer L.L.P.

[57] ABSTRACT

The present invention includes an apparatus and method for continuously adjusting the anode/cathode distance for controlling uniformity of deposition. The entire cathode head is mounted on a lead screw which, when manually turned, moves the cathode head in or out in relation to the anode basket. Alternatively, the lead screw mechanism is driven by a servo motor and is suitably controlled by a computer which monitors the voltage and current in the electroforming cell and adjusts the screw accordingly. The present invention also includes an apparatus and method for a hinged, coated, metal clamping mechanism for fixturing a master against a backplate. To avoid plating of the metallic clamping ring, the metal is coated with a suitable substantially non-conductive, substantially non-chipping, extremely thin material. A hinge mechanism is incorporated onto the clamping ring to allow rotation of the clamping ring, thereby allowing an operator to quickly load or unload parts because of the ease and quickness in opening and closing of the fixture.

9 Claims, 5 Drawing Sheets

40
62
46
85
50
84
52
42
88
86
87
98

40
62
46
89
85
50
84
52
86
42
88
48
87
94

40
62
70
54
64
68
46
50
43
52
42
48
80
90
41

METHOD FOR ELECTROFORMING AN OPTICAL DISK STAMPER

Related Applications

This patent application is a division of, and claims the benefit of, Ser. No. 08/778,044, filed Dec. 26, 1996, now Pat. No. 5,785,826, entitled "APPARATUS AND METHOD FOR ELECTROFORMING" by Alex Greenspan.

TECHNICAL FIELD OF THE INVENTION

This invention generally relates to an apparatus and method for reliable, efficient, cost effective and repeatable electroforming of a master, and more particularly, to an apparatus and method for continuously adjusting the anode/cathode distance to control the uniformity of deposition and for providing a hinged, metal clamping mechanism, coated with a substantially non-conductive, substantially non-chipping, extremely thin material, for efficiently fixturing a master against a backplate.

BACKGROUND OF THE INVENTION

Electroforming generally involves the electrochemical deposition of a layer of metal or alloy from a suitable electrolyte solution onto a pattern usually comprised of a thin layer of metal substrate. More particularly, the article to be plated ("master") is typically connected to a cathode and rotated in a cell. An anode is also typically located in the cell and usually consists of a basket containing the metal to be deposited. The cell also commonly contains an electrolytic (plating) solution which most often forms a conductive path between the basket and the part to be plated. Using this configuration, as sufficient direct current flows through the anode, metallic ions are typically pulled from the electrolytic solution surrounding the cathode and are deposited onto the part connected to the cathode. As the process continues, the deposited plating layer typically increases in thickness, while the material in the anode basket replenishes the metallic ions in the electrolytic solution.

The aforementioned plating process is typically used to produce a die ("stamper", "matrix" or "father") for injection molding of various products including, inter alia, optical discs. The stamper is typically formed ("grown") on a metalized glass master which serves as the mandrel. In preparation for optical disc manufacturing, the surface of the glass master contains microscopic pits of varying lengths in a spiral pattern. Optimally, the surface features of the stamper are an inverse duplicate of the pits on the original glass master. Due to the need for extreme accuracy in duplicating these microscopic pits during the manufacture of optical disc media, it is often critical to strictly maintain the precision of the plating process.

To achieve these optimal results, the stamper is typically manufactured with a uniform thickness. Stampers typically have a nominal thickness of 290 microns (0.290 mm)+/−3 microns, such that the thickness of the stamper does not vary by more than 6 microns. However, with market demands for new higher density formats for optical discs, the thickness variation tolerance most likely will require a decreased thickness variation of +/−1 microns. To obtain a decreased thickness variation for the high density stamper, an overall increased precision in many aspects of the electroforming process will be required.

The thickness variation across the surface of the stamper is partly dependent upon the distance between the cathode and anode in the electroforming device. Even though the amount of overall metal typically remains constant, the thickness profile will usually vary according to the anode/cathode distance. When a cathode is moved closer to the anode, increased deposition often occurs in the center of the stamper. Conversely, with increased distance between the cathode and anode, the thickness in the center of the stamper is often reduced. Thus, an optimal orientation of the cathode to anode distance would preferably result in a minimal thickness variation from the center of the stamper to the edge of the stamper. However, a predetermined setting for the anode/cathode distance typically does not guarantee uniform thickness because many other factors often contribute to thickness variations, i.e. fixturing device, size of baffle opening, temperature and pH.

Currently in the industry, electroforming equipment often provides either for no adjustment between the anode and cathode or for crude and course methods for changing the distance between the anode and cathode. For example, adjusting the distance between the anode and cathode by moving the anode basket is often impractical due to the weight of the basket when filled with the raw metals. Moreover, prior art devices which allow for the replacement of the cathode shaft with a cathode shaft of a differing length do not provide continuous adjustability and often require extra labor and excess expensive parts. Therefore, an apparatus and method for efficiently varying the distance between the anode and cathode to compensate for varying parameters is needed.

As discussed above, a stamper is typically formed on a glass master because of the ionic attraction between the anode and cathode. The ionic attraction is developed from an electrical contact on the surface of the glass master. Because the front surface of the glass master is usually the only surface that is metalized, the metalized surface is typically the only point for the electrical contact. However, to prevent damage to the data which is closer to the center of the master, the electrical contact should preferably avoid contact with the center of the master. Fortunately, ample space typically exists for making an electrical contact on the front surface of the master because the standard industry glass master is 120 mm in radius while the information area only extends from the center of the master out to a radius of about 60 mm.

The metalized layer which forms the electrical contact on the surface of the glass master is typically very thin, i.e. approximately 600 angstroms. To pass high current through this thin layer, a very low initial current is typically used, then the current is increased gradually until the metalized layer is built up by the newly deposited metal ions from the electrolytic solution. Building up the metalized layer of the glass master with the metal deposits is often critical because any portions of the glass master which are not plated will usually burn when the current ramps up. Thus, not only is the inner information area of the master plated, but the outer area which serves as the electrical contact is also typically plated. Plating the outside area which serves as the electrical contact usually results in part of the fixture being unintentionally plated. Plating deposits on the fixture is often undesirable because of the extra maintenance required to remove the plating from the fixture and the adverse affects on thickness variation.

A fixture which sufficiently seals off metal parts from the build-up of plating during the plating operation is needed. A non-metallic material is needed which is both compatible with the plating bath and includes adequate mechanical properties. Prior art clamping rings typically include a circular disc with a threaded rim which is threadedly received into the backplate. Threaded fittings are problematic because of variations in the torque applied by individual operators when rotating the clamping ring, thereby resulting in an unequal seal applied around the ring, difficulty in obtaining repeatable compression and variations in the overall contact pressure against the sides of the clamping ring. These prior art clamping rings are typically constructed of a plastic material which is not sufficiently rigid to provide an adequate seal. To obtain an adequate seal, the material should be rigid, but not brittle. Most often, CPVC or polypropylene are used for this process; however, both of these materials are somewhat soft and not dimensionally stable at the temperatures required, i.e. 20°–65° C. Furthermore, seals on currently available fixtures typically leak and often require substantial maintenance. A fixture with increased performance, less maintenance and easier on and off loading is needed in the electroforming industry.

SUMMARY OF THE INVENTION

The present invention includes an apparatus and method for continuously adjusting the anode/cathode distance for controlling uniformity of deposition. The entire cathode head is mounted on a lead screw which, when manually turned, moves the cathode head in or out in relation to the anode basket. Alternatively, the lead screw is driven by a servo motor which is controlled by a computer.

The present invention also includes an apparatus and method for a hinged, coated, metal clamping mechanism for fixturing a master against a backplate. The metal ring includes an O-ring to provide a seal against the part to be plated. To avoid plating of the metal ring, the metal is coated with a suitable substantially non-conductive, substantially non-chipping, extremely thin material. A hinge mechanism is incorporated onto the clamping ring to allow rotation of the clamping ring, thereby allowing an operator to-quickly load or unload parts because of the ease and quickness in opening and closing of the fixture.

BRIEF DESCRIPTION OF THE DRAWING FIGURES

Preferred exemplary embodiments of the present invention will hereinafter be described in conjunction with the appended drawing figures, wherein like numerals denote like elements and:

Figures 4A, 4B, 4C:
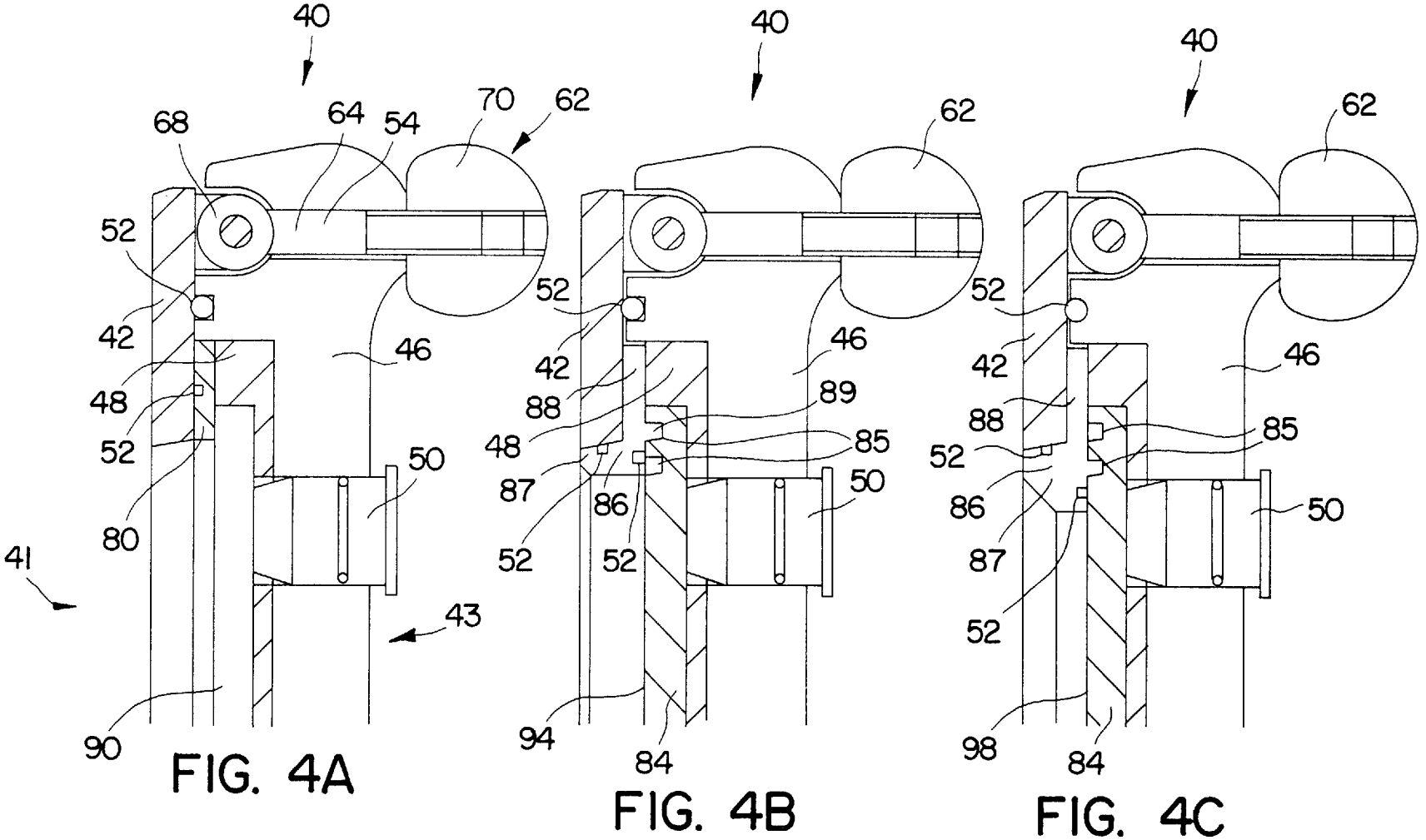
Figure 5:
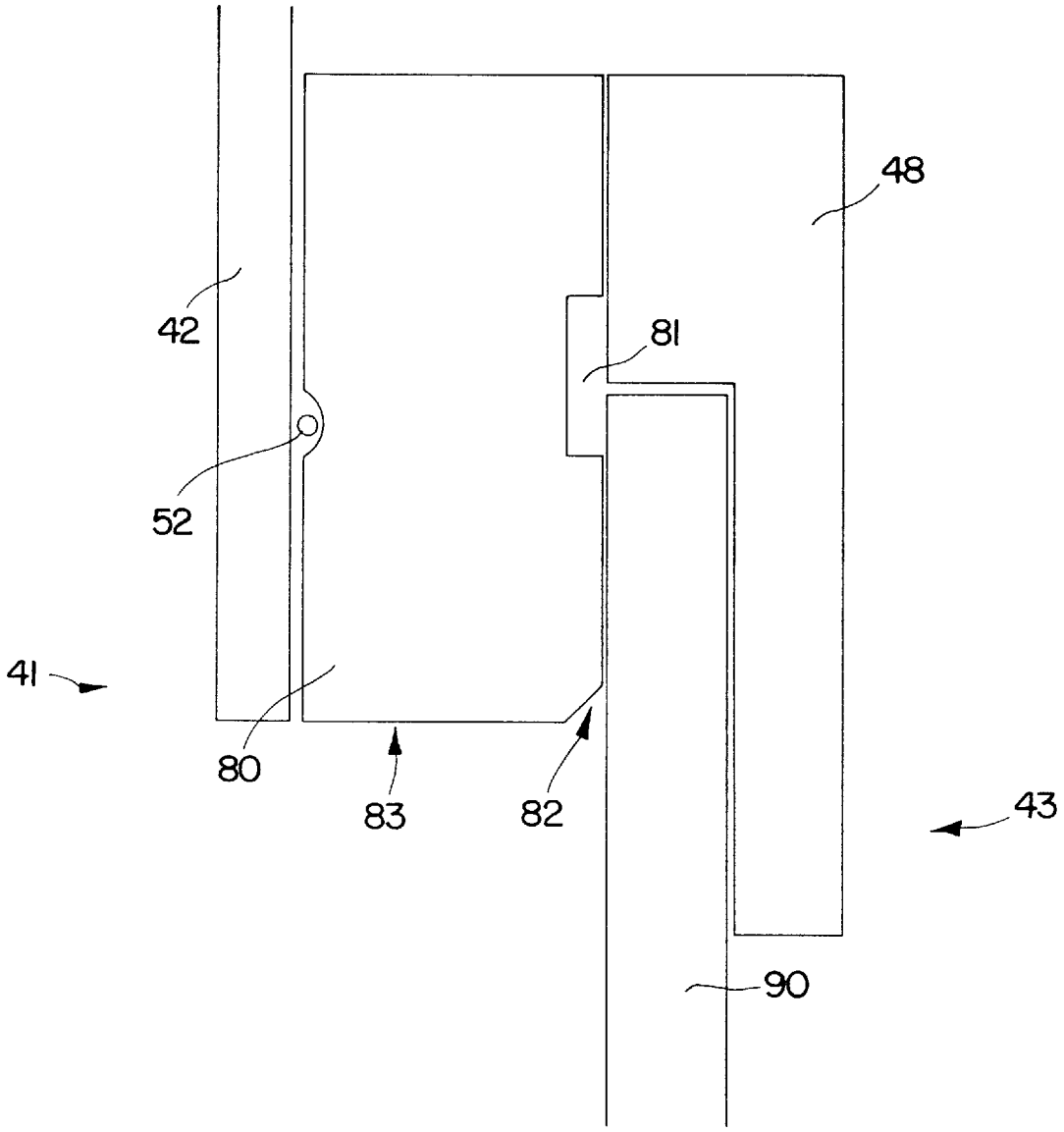

FIG. 4*a* shows an exemplary backplate 40 for creating a "father" from a glass master in accordance with the present invention;

FIG. 4*b* shows an exemplary backplate 40 for creating a "mother" from a "father" in accordance with the present invention;

FIG. 4*c* shows an exemplary backplate 40 for creating a stamper from a "mother" in accordance with the present invention, and FIG. 5 shows a detailed view of an exemplary contact ring incorporated into a backplate.

DETAILED DESCRIPTION OF A PREFERRED EXEMPLARY EMBODIMENT

Figure 1:
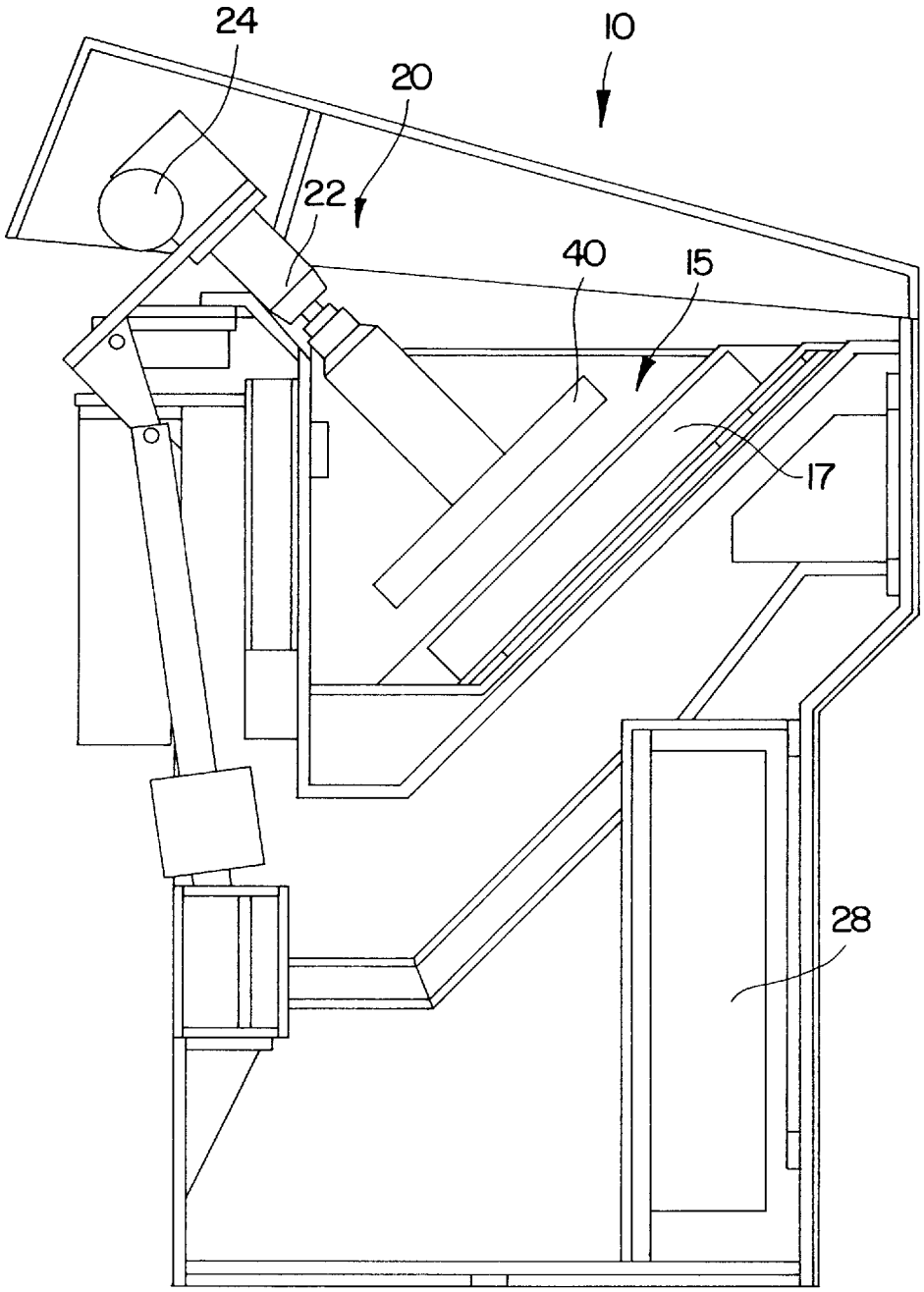
FIG. 1 shows an exemplary electroforming apparatus in accordance with the present invention.

Referring to FIG. 1, an apparatus and method according to various aspects of the present invention is suitably configured to continuously adjust the anode 17-to-cathode assembly 20 distance thereby controlling uniformity of deposition. With momentary reference to FIG. 3, the apparatus and method according to various aspects of the present invention is also suitably configured for providing a hinged, coated, metal clamping mechanism for efficiently fixturing a master into a backplate 40. While the manner in which the electroforming is accomplished is described in greater detail below, in general with reference to FIGS. 1 and 3, clamping ring 42 secures master 90 onto backplate 40, then screw 24 adjusts cathode assembly 20 to an optimal distance from anode basket 17 in preparation for the electroforming process.

With continued reference to FIG. 1, electroforming device 10 preferably includes, inter alia, cell 15, anode basket 17 and cathode assembly 20. In general, anode basket 17 and cathode assembly 20 are preferably aligned and are preferably within cell 15. Anode basket 17 suitably comprises any device in accordance with the present invention capable of holding a positive voltage potential and allowing metal ions to be liberated from metal pieces contained therein. In accordance with a preferred embodiment of the present invention, anode basket 17 comprises a titanium basket substantially filled with raw nickel pellets.

With continued reference to FIG. 1, cathode assembly 20 suitably comprises any device in accordance with the present invention capable of holding a negative electrical potential and attracting ions at a rate which is proportional to the voltage potential across anode 17 and cathode assembly 20 for a given resistance between anode 17 and cathode assembly 20. In accordance with a preferred embodiment of the present invention, cathode assembly 20 comprises a rotatable head 22 mechanically attached to an adjustable screw 24 and slides upon rails 23. Backplate 40 is preferably attached to the opposite end of head 22. Rotatable head 22 preferably rotates at approximately 0–90 rpm.

Figure 2:
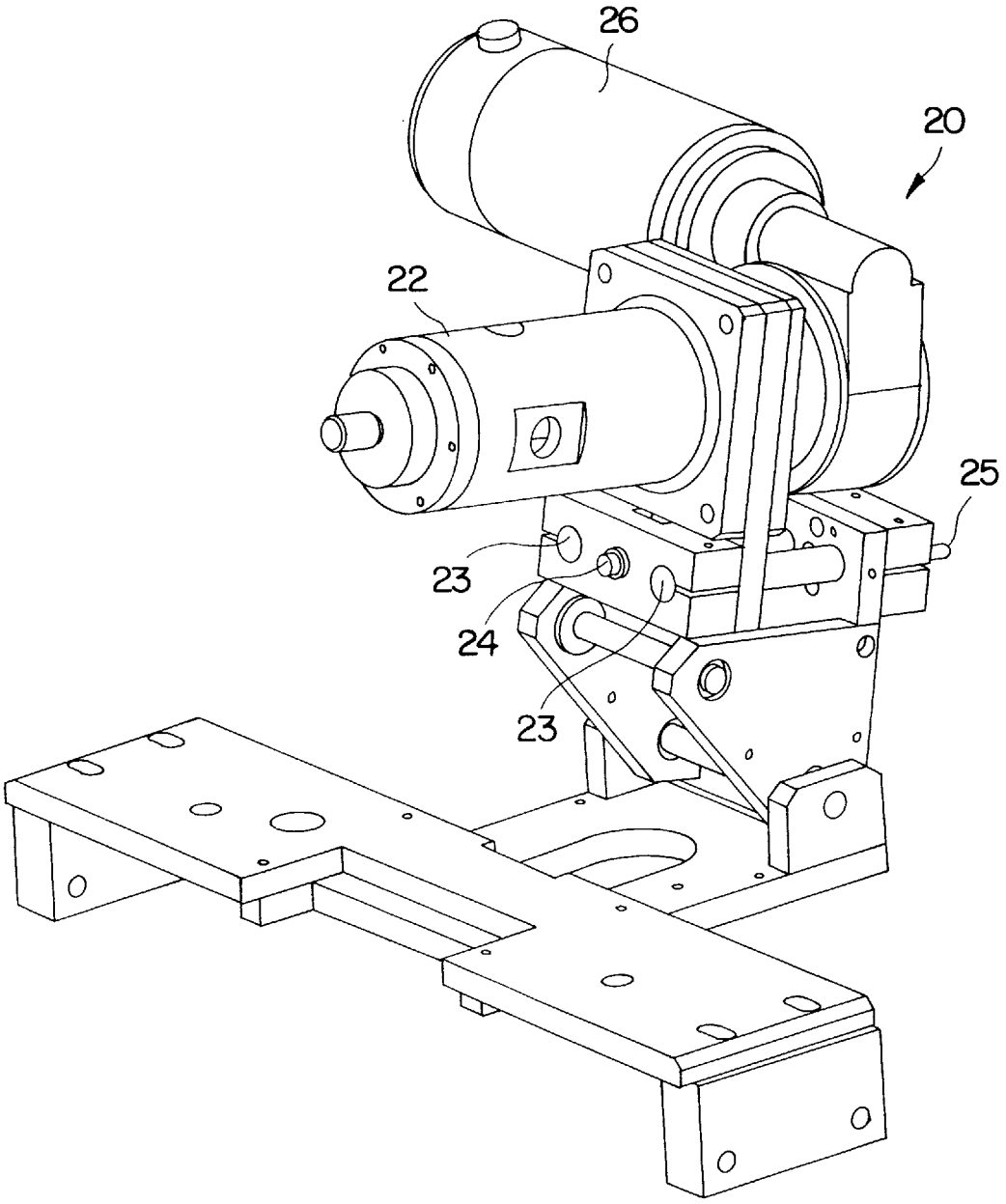
FIG. 2 shows an exemplary cathode assembly in accordance with the present invention.

With reference to FIGS. 1 and 2, cathode assembly 20 is suitably translated along the axis perpendicular to anode basket 17. More particularly, entire cathode assembly 20 head is suitably mounted on lead screw 24 and rails 23 which, when manually turned at hexagonal bolt head 25, preferably moves cathode assembly 20 in or out along rails 23 in relation to anode basket 17. In a preferred embodiment, the total travel of cathode assembly 20 along rails 23 is approximately two inches thereby providing sufficient adjustment to greatly vary the thickness uniformity of the stamper.

Furthermore, once adjusted, the positioning of lead screw 24 is suitably highly repeatable, such that the dimension and quality of the parts are highly predictable, thereby increasing productivity.

With reference to FIGS. 1 and 2, in a preferred embodiment, lead screw 24 is suitably manually rotated at hexagonal bolt head 25. In an alternative embodiment, lead screw 24 is suitably driven by servo motor 26 which is suitably controlled by computer 28. Computer 28 suitably monitors the voltage and current in electroforming cell 15 and adjusts lead screw 24 accordingly. Thus, cathode assembly 20-to-anode 17 distance is alternatively dynamically controlled with feedback from the voltage/current ratio across and through electroforming cell 15. In an alternative embodiment, computer 28 suitably compensates for the feedback from the voltage/current ratio for the complex changes which take place due to anode 17 material geometric irregularities and flow patterns and micro temperature variations within electroforming cell 15.

Figure 3:
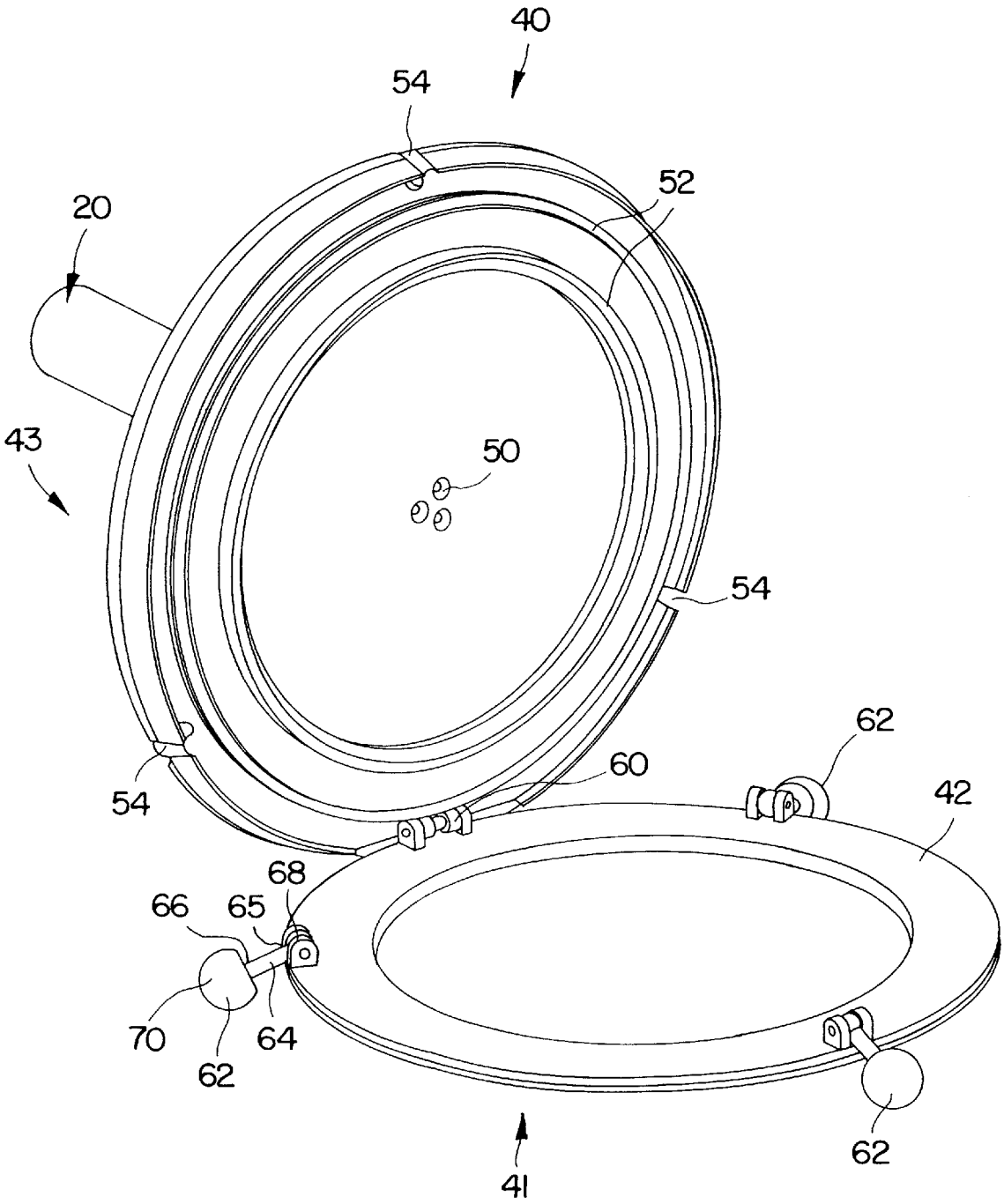
FIG. 3 shows an exemplary backplate in accordance with the present invention.

With reference to FIGS. 3 and 4, backplate 40 suitably comprises any device in accordance with the present invention capable of holding a part to be plated. In accordance with a preferred embodiment of the present invention, backplate 40 includes a substantially circular disc with a front side 41 and a rear side 43. Backplate 40 preferably includes a clamping ring 42, a base 46, a metallic cup 48, three buttons 50, O-rings 52 and three recesses 54 substantially equally spaced about backplate 40. In a preferred embodiment, base 46 and a metallic cup 48 are substantially circular discs. Base 46 and metallic cup 48 preferably include a rim emanating along their circumference toward front side 41. Metallic cup 48 is comprised of any suitable material capable of conducting electricity, but preferably is comprised of a metal. Metallic cup 48 is preferably reciprocally received in front side 41 of base 46, while master 90 is reciprocally received into front side 41 of metallic cup 48. Buttons 50 are preferably substantially equally spaced substantially near the center of backplate 40. Buttons 50 are reciprocally received through base 46 and metallic cup 48 and abuts rear side 43 of master 90, such that when force is applied on rear side 43 of buttons 50, master 90 is forced away from front side 41 of backplate 40.

With reference to FIG. 3, to prevent fixture leakage and to reduce maintenance requirements, clamping ring 42 preferably includes a substantially circular ring comprised substantially of a rigid material, i.e. metal, ceramic, and/or the like. Clamping ring 42 is preferably comprised of stainless steel, but clamping ring 42 is alternatively comprised of any suitable metal which is comparatively rigid such as aluminum, titanium and/or ordinary steel. Unlike plastic clamps, the properties of a stainless steel clamp also often enable repeatable compression and contact pressure. Clamping ring 42 suitably provides for a uniform compression of O-rings 52 thereby sealing off the metallic contacts of electroforming device 10. Any of the aforementioned metallic surfaces would normally contaminate the solution within cell 15; however, the metallic surfaces are suitably coated with a non-metallic surface which avoids contact with the plating solution. To avoid plating of clamping ring 42, clamping ring 42 is preferably coated almost completely with a suitable substantially non-conductive, substantially non-chipping, extremely thin material. The non-conductive material is not only preferably chemically compatible with the plating bath, but also suitably bonds to the metallic part and resists abrasion. The coating is suitably thin so as to avoid substantially increasing the dimensions of clamping ring 42. Coating of the metallic parts substantially improves the electroforming process by reducing unwanted plating to the fixture.

Prior art clamping rings typically are partially or completely removed from the fixture before loading or unloading the desired part. This process is often cumbersome, time consuming and adds to the risk of damaging the glass master or metal parts. In a preferred embodiment of the present invention, due to the strength of the stainless steel, a hinge device 60 is suitably attached between clamping ring 42 and backplate 40 to allow rotation of clamping ring 42. Rotation of clamping ring 42 allows an operator to quickly load or unload parts because of the ease and quickness in opening and closing of backplate 40.

More particularly, with continued reference to FIG. 3, clamping ring 42 preferably includes hinge device 60 which is pivotally attached to base 46 along a predetermined length of front side 41 of backplate 40. Clamping ring 42 preferably includes a plurality of virtually identical locking devices 62 substantially equally spaced about clamping ring 42. In a preferred embodiment, clamping ring 42 preferably includes three locking devices 62. Each locking device 62 consists of a dowel 64 having a first end 65 and a second end 66. First end 65 of dowel 64 is suitably attached to hinge 68 which is mounted on a predetermined point on clamping ring 42. Second end 66 of dowel 64 is suitably attached to an object with a wider diameter than dowel 64, i.e. sphere 70. Upon rotation of hinge device 60 of clamping ring 42, clamping ring 42 abuts backplate 40. By rotation of locking devices 62 into recesses 54, dowels 64 are preferably reciprocally received into recesses 54 and spheres 70 rest upon rear side 43 of backplate 40 and on ridge of base 46, thereby providing pressure between clamping ring 42 and front side 41 of backplate 40.

With reference to FIGS. 3 and 4*a–c*, O-rings 52 are preferably set within circular channels of contact ring 80, base 46 and plastic holder 86. O-rings 52 provide an increased seal by substantially preventing the plating solution from exiting the cup area and attaching to electroplating device 10.

FIG. 4*a* shows an exemplary backplate 40 for creating a "father" 94 from a glass master 90. With reference to FIG. 4*a*, contact ring 80 suitably comprises any device in accordance with the present invention capable of transferring current to the metallic surface on the front side 41 of glass master 90. In accordance with a preferred embodiment of the present invention, contact ring 80 includes a conducting material such as stainless steel and/or the like. Contact ring 80 is preferably set below rear side 43 of clamping ring 42, reciprocally received within the rim of base 46, over front side 41 of the rim of metallic cup 48 and over the outer circumference of master 90. Additionally, contact ring 80 helps prevent the plating solution from seeping out from the surface of master 90 and onto electroforming device 10, thereby substantially limiting the region of plating to the metalized glass. Because contact ring 80 covers the outer circumference of master 90, contact ring 80 oftentimes becomes plated to master 90, thereby essentially becoming a part of the resulting stamper/father 94. After removing stamper/father 94 from backplate 40, contact ring 80 is typically separated from father 94 by a suitable means.

With reference to FIG. 5, when clamping ring 42 exerts pressure against contact ring 80, the rear surface 43 of contact ring 80 oftentimes experiences an uneven force, i.e. bending, against metallic cup 48 and master 90. To allow contact ring 80 to substantially evenly abut front side of the rim of metallic cup 48 and the outer circumference of master 90, a recess 81 is incorporated into rear surface 43 of contact ring 80 such that contact ring 80 does not contact interface area between metallic cup 48 and master 90.

With continued reference to FIG. 5, rear 43, inner 83 surface of 15 contact ring 80 includes beveled edge 82. Inner surface 83 of contact ring 80, excluding beveled edge 82, is also preferably coated with a suitable non-conductive material which substantially prevents plating against inner surface 83 of contact ring 80. Consequently, beveled edge 82 abuts master 90, so when plating is deposited around the circumference of master 90, beveled edge causes a defined perimeter along the edge of the deposit. The defined sloping edge of the deposit allows substantially easier separation of master 90 from contact ring 80. Beveled edge 82 also suitably allows plating on the thin metalized layer of master 90 along the area which electrically contacts contact ring 80, thereby preventing the burning of the metalized layer during increases of current through the metalized layer.

FIG. 4*b* shows an exemplary backplate 40 for creating a "mother" 98 from a "father" 94. Electrical contact for metal-to-metal parts is typically initiated from the back of the part because the entire part, including the back surface, is conductive. With reference to FIG. 4*b*, the components of backplate 40 are preferably arranged substantially similar to FIG. 4*a* except that, because the arrangement is preferably established for creating mother 98 from father 94, father 94 is suitably comprised of a conductive metal so contact ring 80 is not necessary for transferring current to front side 41 of father 94. Instead, spacer 84 is preferably reciprocally received within metallic cup 48 in place of master 90 and father 94 is preferably set on front side 41 of spacer 84. In accordance with a preferred embodiment of the present invention, spacer 84 includes a circular disc comprised of stainless steel or any other suitable conductive alloy.

Additionally, plastic holder 86 is preferably an L-shaped circular ring including a foot 87 and a base 88. Base 88 of plastic holder 86 is preferably set below rear side 43 of clamping ring 42 and foot 87 wraps around inside edge of clamping ring 42. Rear side 43 of base 88 is also preferably set over front side 41 of rim of metallic cup 48 and over the outer circumference of father 94 and stainless steel spacer 84. A finger 89 preferably emanates from rear side 43 of foot 87 and substantially along the entire circumference of foot 87. Finger 89 is preferably reciprocally received into one of two circular channels 85 within front side 41 of spacer 84, thereby enabling easy location and stable support for placement father 94. By using a rear entrance for the electrical contact (from metallic cup 48 through spacer 84 to father 94), electroforming device 10 is substantially sealed off from the plating material during the plating process. Thus, the plating material is substantially restricted from contact with electroforming device 10 and maintenance requirements are substantially reduced because of the reduced build-up of metal on electroforming device 10.

FIG. 4*c* shows an exemplary backplate 40 for creating a stamper (not shown) from "mother" 98. With reference to FIG. 4*c*, the components of backplate 40 are arranged substantially similar to FIG. 4*b* except that mother 98 preferably replaces father 94. Additionally, plastic spacer 86 preferably includes a longer base 88 such that finger 89 of plastic spacer 86 is reciprocally received into inner circular channel 85 (closer to the center of stainless steel spacer 84 because mother 98 has a smaller diameter) of stainless steel spacer 84 thereby enabling easy location and stable support for placement of father 94.

It will be apparent to those skilled in the art that the foregoing detailed description of a preferred embodiment of the present invention is representative of an apparatus and method for a continuously manually adjustable anode 17/cathode assembly 20 distance and a hinged, coated, metallic clamping mechanism within the scope and spirit of the present invention. Further, those skilled in the art will recognize that various changes and modifications may be made without departing from the true spirit and scope of the present invention. For example, screw 24 used to continuously adjust cathode assembly 20 may suitably be replaced with any configuration capable of adjusting cathode assembly 20/anode 17 distance. Those skilled in the art will recognize that the invention is not limited to the specifics as shown here, but is claimed in any form or modification falling within the scope of the appended claims. For that reason, the scope of the present invention is set forth in the following claims.

I claim:

1. A method for electroforming an optical disk stamper by controlling the uniformity of deposition onto a mandrel, said method comprising the steps of:

providing an anode;

providing a cathode assembly facing said anode and at a distance from said anode, said cathode assembly comprising a backplate having a base, said cathode assembly being mounted on a lead screw;

securing said mandrel to said backplate;

rotating said lead screw to translate said cathode assembly to a preselected distance along an axis normal to said anode to facilitate uniform deposition by optimizing said distance to compensate for factors affecting the uniformity of said electroforming process;

relatively rotating said anode and said cathode assembly;

transferring current to said mandrel; and, electroforming said mandrel.

2. The method of claim 1, wherein said securing step includes securing said mandrel between a clamping ring and a contact ring of said backplate.

3. The method of claim 1, wherein said securing step includes rotating a clamping ring against said backplate to secure said mandrel between said clamping ring and a contact ring of said backplate.

4. The method of claim 1, wherein said securing step includes inserting an O-ring between a clamping ring and said base of said backplate to impede the migration of processing solution between said clamping ring and said base of said backplate.

5. The method of claim 1, wherein said securing step comprises the step of rotating a locking device around said backplate, said locking device having a sphere and a dowel, wherein said dowel includes a first end and a second end, said first end of said dowel pivotally attached to said backplate and said sphere attached to said second end of said dowel.

6. The method of claim 1, wherein said step of rotating said lead screw comprises the step of automatically rotating said lead screw using a computer communicating with a servo motor operatively connected to said lead screw.

7. The method of claim 1 wherein said electroforming step includes electroforming an optical disk stamper having a thickness variation of about 6 microns.

8. The method of claim 1 wherein said electroforming step includes electroforming an optical disk stamper having a thickness variation of about 2 microns.

9. A method for securing a mandrel between a clamping ring and a backplate in preparation for electroforming an optical disk stamper, said clamping ring having a locking device, said locking device including a dowel having a first end and a second end and a sphere attached to said second end of said dowel, said first end of said dowel rotatably connected to said clamping ring, said backplate having a base and a notch within said base, said base having a front surface and a rear surface, said method comprising the step of rotating said sphere around said base of said backplate such that said dowel rests within said notch and said sphere rests against said rear surface of said base.

* * * * *